US009725955B2

(12) United States Patent
Skjaerseth et al.

(10) Patent No.: US 9,725,955 B2
(45) **Date of Patent: *Aug. 8, 2017**

(54) ARRANGEMENT FOR CONTINUOUS CIRCULATION OF DRILLING FLUID DURING DRILLING OPERATIONS

(71) Applicant: West Drilling Products AS, Stavanger (NO)

(72) Inventors: Odd B. Skjaerseth, Stavanger (NO); Bjorn Eilertsen, Hundvag (NO)

(73) Assignee: West Drilling Products AS, Stavanger (NO)

( * ) Notice: Subject to any disclaimer, the term of this patent is extended or adjusted under 35 U.S.C. 154(b) by 253 days.

This patent is subject to a terminal disclaimer.

(21) Appl. No.: 14/408,520

(22) PCT Filed: Jun. 13, 2013

(86) PCT No.: PCT/NO2013/050107
§ 371 (c)(1),
(2) Date: Dec. 16, 2014

(87) PCT Pub. No.: WO2013/191559
PCT Pub. Date: Dec. 27, 2013

(65) Prior Publication Data

US 2015/0191977 A1 Jul. 9, 2015

(30) Foreign Application Priority Data

Jun. 18, 2012 (NO) ..... 20120701

(51) Int. Cl.
*E21B 3/02* (2006.01)
*E21B 19/16* (2006.01)
(Continued)

(52) U.S. Cl.
CPC ..... *E21B 3/02* (2013.01); *E21B 19/00* (2013.01); *E21B 19/16* (2013.01); *E21B 21/10* (2013.01)

(58) Field of Classification Search
CPC ..... E21B 19/00; E21B 19/16; E21B 21/10; E21B 3/02
(Continued)

(56) References Cited

U.S. PATENT DOCUMENTS 2,207,149 A * 7/1940 Hild ..... E21B 33/06 166/86.1
3,994,350 A 11/1976 Smith et al.
(Continued)

FOREIGN PATENT DOCUMENTS

GB 2 399 112 A 9/2004
NO 326427 12/2008
(Continued)

OTHER PUBLICATIONS

International Search Report and Written Opinion for PCT/NO2013/050107, dated Sep. 10, 2014.
(Continued)

*Primary Examiner* — Taras P Bemko
(74) *Attorney, Agent, or Firm* — Andrus Intellectual Property Law, LLP

(57) ABSTRACT

A circulation unit is for an arrangement arranged to continuously circulate drilling fluid during drilling. A housing is provided with a center bore which is defined by upper and lower annular sealing elements which are rotatably supported in the housing. The sealing elements are provided with a center opening which, by the expansion of said sealing elements, is closable or fits tightly against a pipe. A gate valve in a closed state forms a fluid-tight partition between upper and lower chambers in the housing. Each of
(Continued)

the sealing elements is connected in a fluid-tight manner to a rotatable packer pipe surrounded by a packer assembly that fits tightly against the circumference of the packer pipe and against the housing. An arrangement is for the continuous circulation of drilling fluid during drilling, including as circulation unit arranged between upper and lower rotary units.

23 Claims, 4 Drawing Sheets

(51) Int. Cl.
*E21B 21/10* (2006.01)
*E21B 19/00* (2006.01)

(58) Field of Classification Search
USPC ..... 175/218
See application file for complete search history.

(56) References Cited

U.S. PATENT DOCUMENTS

| | | | | |
|---|---|---|---|---|
| 4,449,596 | A | 5/1984 | Boyadjieff | |
| 6,412,554 | B1 | 7/2002 | Allen et al. | |
| 6,591,916 | B1 | 7/2003 | Ayling | |
| 6,688,394 | B1 | 2/2004 | Ayling | |
| 7,107,875 | B2 | 9/2006 | Haugen et al. | |
| 2002/0134555 | A1* | 9/2002 | Allen | E21B 3/04 166/377 |
| 2003/0075023 | A1 | 4/2003 | Robichaux | |
| 2003/0221519 | A1* | 12/2003 | Haugen | E21B 3/04 81/57.15 |
| 2013/0192895 | A1* | 8/2013 | Krohn | E21B 3/02 175/57 |

FOREIGN PATENT DOCUMENTS

| | | |
|---|---|---|
| NO | 326427 B1 | 12/2008 |
| NO | 20100123 | 7/2011 |
| NO | 333021 | 2/2013 |
| WO | 0169034 | 9/2001 |
| WO | 0236928 | 5/2002 |
| WO | 2008147210 | 12/2008 |
| WO | 2011093716 | 8/2011 |

OTHER PUBLICATIONS

International Search Report for PCT/NO20111000028 dated Apr. 4, 2011.
Written Opinion for PCT/NO2011/000028 dated Apr. 4, 2011.
International Search Report, PCT/NO2013/050107, date of mailing Sep. 20, 2013.
Written Opinion, PCT/NO2013/050107, date of mailing Sep. 20, 2013.
International Search Report, PCT/NO2014/050047, date of mailing Aug. 22, 2014.
Written Opinion, PCT/NO2014/050047, date of mailing Aug. 14, 2014.

* cited by examiner

ARRANGEMENT FOR CONTINUOUS CIRCULATION OF DRILLING FLUID DURING DRILLING OPERATIONS

CROSS-REFERENCE TO RELATED APPLICATIONS

This application is the U.S. national stage application of International Application PCT/NO2013/050107, filed Jun. 13, 2013, which international application was published on Dec. 27, 2013, as International Publication WO2013/191559 in the English language. The international application is incorporated herein by reference, in entirety. The international application claims priority to Norwegian Patent Application No. 20120701, filed Jun. 18, 2012, which is incorporated herein by reference, in entirety.

FIELD

A circulation unit is described and so is an arrangement for the continuous circulation of drilling fluid during continuous drilling, in which a circulation unit is arranged between upper and lower rotary units, the circulation unit and the rotary units being vertically displaceable along a guide track.

BACKGROUND

It is known within the oil- and gas-drilling industry to take measures for the circulation of drilling fluid to be maintained in the borehole while a drill string is being extended. NO 326427 discloses a system in which a top-drive drilling machine with a hollow drive shaft cooperates with a sluice chamber provided with seals surrounding the pipe, the drilling fluid being directed alternately through the drive shaft via a first fluid inlet, when a continuous drill string is connected to the drilling machine, and through the sluice chamber via a second fluid inlet, when the upper end of the pipe string is arranged in the sluice chamber and is going to be connected to a new pipe section.

A drawback of the prior art according to NO 326427 is that the pipe-string rotation ceases when the pipe string is to be extended. It is known within the industry that it is an advantage to maintain the pipe-string rotation both in order to reduce the risk of the pipe string sticking and in order to improve the productivity, for example increase the drilling capacity by not having a stop in the actual drilling operation while the drill string is being extended.

From NO 20100123 an arrangement is known in which, between a first top-drive drilling machine and a borehole, a second drilling machine is arranged, which is provided with a rotary table arranged to take the weight of a pipe string, a rotary-drive unit arranged to continuously rotate the pipe string, and a fluid chamber which is arranged to connect a pipe-string end portion to a drilling-fluid system in a fluid-communicating manner, the fluid chamber being provided with pipe-string ports including means arranged to fluid-sealingly close the pipe-string ports, and the second drilling machine further being provided with a power tong which is arranged to connect/release an element to/from the pipe string, the power tong being arranged in the fluid chamber. The drawback of this arrangement is that the rotary-drive unit is directly connected to the fluid chamber (sluice chamber) and the power tong is enclosed in the fluid chamber. Here, an adjustment of the power tong to the relevant pipe dimension that is being handled must be made by intervention in the fluid chamber.

SUMMARY

The invention has for its object to remedy or reduce at least one of the drawbacks of the prior art or at least provide a useful alternative to the prior art.

The object is achieved through features which are specified in the description below and in the claims that follow.

In what follows, the term "drill string" is used as a collective term for all types of pipe strings that, by the rotation of an end portion, form a borehole into the underground by suitable drill-bit elements grinding up the underground material, and an entering drilling fluid carrying the ground-up underground material out of the borehole by means of a return flow to the surface.

Unless explicitly mentioned, the term "pipe" is used, in what follows, as a collective term for individual pipes, pipe sections made up of several individual pipes, and a pipe string built by joining together several individual pipes that can be screwed together or several pipe sections. "Pipes" may also include so-called saver subs which are used as a connection between the pipe string and a rotary unit, possibly adapted for drilling-fluid supply to the pipe string.

A circulation unit is provided, arranged to supply drilling fluid through an open upper end of a pipe string. The circulation unit is formed of a housing with a centre bore ex tending through it. At either end of the housing, a rotatably supported sealing element is arranged, arranged to fit tightly around a pipe portion. Each of the rotatable sealing elements is arranged to close the respective end of the centre bore, both when there is a pipe extending through the sealing element and when the sealing element is not surrounding a pipe, for example by an internal hydraulic pressure being applied to the sealing element from an associated pressure-supply unit. Within the sealing elements, that is to say in the direction of the interior of the housing, and connected in a fluid-tight manner to an end face of the sealing element, a rotatable packer pipe is arranged, surrounded by a packer assembly resting against a portion of the circumference of the packer pipe and forming a sealing barrier between the chamber and the bearing and external periphery of the sealing element. The drilling fluid is thereby prevented from entering pressure-fluid supply channels surrounding the circumference of the sealing elements, and mixing with the pressure fluid which is preferably also used as a lubricant for the bearing of the sealing element. The packer assembly is typically so-called wash-pipe seals which maintain their sealing function also when the packer pipe is rotating and the drilling fluid is under high pressure. The abutment surface on the packer pipe typically has a very smooth surface so that the packer assembly can withstand long-term abutment against the rotating packer pipe without suffering wear.

The housing is divided into two chambers by means of a gate valve arranged to form, in an open position, a centre opening which forms a connection between said two chambers and to form, in a closed position, a fluid-tight partition between said chambers. The gate valve may typically be a ball valve with a rotational axis that is perpendicular to the centre axis of the circulation unit.

Each of the two chambers is provided with a fluid port connected to a drilling-fluid system via first and second drilling-fluid lines and an associated valve system in order thereby to allow drilling fluid to be directed into the respective chamber, possibly also to drain the chamber.

A third drilling-fluid line, which is connected to said drilling-fluid system and valve system, is connected to a saver sub which is arranged to be connected to an upper end of a pipe in order thereby to allow drilling fluid to be directed into the pipe. The saver sub is rotatable relative to the third drilling-fluid line. The saver sub is provided with at least an upper portion which is suitable as an abutment portion for a tong in connection with making up and breaking out the pipe-connecting unit with/from a pipe.

In professional circles, the circulation unit is also termed a continuous-drilling and circulation unit (CDU).

An arrangement for the continuous circulation of drilling fluid during the continuous rotation of a drill string is provided as well. In an operative position, a circulation unit in accordance with the invention is arranged with its centre axis coinciding with a drilling-centre axis and between first and second rotary units. By means of a drive, the circulation unit and the two rotary units can be moved vertically along guide tracks suitable therefor. The circulation unit and at least one of the rotary units can be moved vertically independently of each other.

Each of the rotary units typically includes a rotatable tong of the kind that can grip around a pipe portion and hold it fixed, a hanging-off device, typically in the form of a slips arrangement of a kind known per se arranged to rest against a downward-facing shoulder portion of a pipe sleeve or the like, and a rotary bearing which is arranged to support the tong and/or the hanging-off device. The rotatable tong is provided with a rotary drive.

A drilling operation with continuous drilling-fluid circulation and continuous drill-string rotation in accordance with the invention may typically be performed in the following manner:

1. In a first phase of a drilling sequence, the following takes place:
   a) An upper end of the drill string projects through the circulation unit. The third line is connected via the saver sub to the upper end of the drill string.
   b) Drilling fluid is supplied to a centre bore of the drill string via the saver sub.
   c) The drill string is kept in rotation by the upper rotary unit.
   d) The upper and lower sealing elements are open, and the drill string is moved freely relative to the circulation unit.
   e) The upper rotary unit and the drill string are moved downwards according to the achieved rate of penetration.

2. In a second phase of the drilling sequence, the following takes place:
   a) The circulation unit and the lower rotary unit are moved upwards towards the upper rotary unit.
   b) The upper end of the drill string and a lower portion of the saver sub are moved into the circulation unit so that the upper end of the drill string is in a lower chamber.
   c) The drill string is gripped by the lower rotary unit which takes over the drill-string rotation. The saver sub remains hung off in the upper rotary unit. The sealing elements are closed around the rotating drill string and the saver sub, respectively.
   d) Drilling fluid is supplied to the lower chamber through the lower fluid port. The saver sub is disconnected from the drill string by the upper rotary unit holding the saver sub back while the lower rotary unit is rotating the drill string. The saver sub is pulled out of the lower chamber, the gate valve is closed, and the supply of drilling fluid through the saver sub is stopped.
   e) The upper sealing element is opened, and the saver sub is pulled out of the circulation unit.
   f) The drilling operation is maintained by the lower rotary unit and circulation unit being rotated and displaced, and the supply of drilling fluid is maintained through the lower chamber which is kept closed to the surroundings by means of the closed gate valve and the lower sealing element which fits tightly around a portion of the drill string.

3. In a third phase of the drilling sequence, the following takes place:
   a) The next pipe to be joined to the drill string is moved in to the drilling-centre axis by means of a manipulator or the like and is held fixed there.
   b) The upper rotary unit rotates the saver sub to connect it to the upper end of the pipe.
   c) The pipe is moved with its lower end into the circulation unit while the upper sealing element is open.
   d) The upper sealing element is closed around the pipe.
   e) Drilling fluid is supplied to the upper chamber through the saver sub, possibly through the upper fluid port, the gate valve is opened, and the supply of drilling fluid through the lower fluid port is stopped as the drill string is now being supplied with drilling fluid from the upper chamber and through the open gate valve.
   f) The upper rotary unit moves the pipe, during rotation, to connect it to the drill string, the pipe being rotated faster than the drill string.
   g) Drilling fluid is supplied to the drill string through the saver sub. The sealing elements are opened, possibly after the chambers of the circulation unit have been drained.

The drilling operation continues by the steps 1a)-3g) being repeated.

The drilling operation may also be performed with variants that deviate somewhat from what has been described above, without diverging from the scope of the invention.

It represents a considerable simplification of the operation and maintenance of systems for continuous drilling-fluid circulation during the continuous rotation of a drill string in that all elements that provide rotation and hanging-off of a pipe or pipe string are arranged outside the circulation unit. Any replacement of components in connection with maintenance or adjustment for another pipe dimension may be carried out without intervening in the circulation unit.

The arrangement in accordance with the invention exhibits a great extent of flexibility when drilling fluid is circulated continuously during the continuous rotation of a drill string, in that the upper rotary unit may be displaced independently of the lower rotary unit and the circulation unit. Further flexibility may be achieved by the lower unit being displaceable independently of the circulation unit.

In a first aspect, the invention relates more specifically to a circulation unit for an arrangement arranged to continuously circulate drilling fluid during drilling, in which a housing is provided with a centre bore arranged to accommodate a portion of a pipe;

the centre bore is defined by upper and lower annular sealing elements which are rotatably supported in the housing;

the sealing elements are provided with a centre opening which, by the expansion of said sealing elements, is closable or fits tightly against the pipe by the abutment of an inner sealing surface against the pipe; and a gate valve in a closed state forms a fluid-tight partition between an upper chamber and a lower chamber in the housing, characterized by each of the sealing elements being connected in a fluid-tight manner to a rotatable packer pipe projecting into the respective chamber and being surrounded by a packer assembly that fits tightly against the circumference of the packer pipe and against the housing.

The sealing element may be provided with an expandable cavity which is in fluid communication with a pressure-fluid port via several fluid passages and an annular space surrounding the sealing element.

Between the packer assembly and a pressure-fluid seal defining an annular space surrounding the sealing element, a packer drain may be arranged.

The packer pipe may be connected to the sealing element via a bearing ring which fits fluid-tightly against the end faces of the sealing element.

In a second aspect, the invention relates more specifically to an arrangement for the continuous circulation of drilling fluid during continuous drilling, in which a circulation unit as described above is arranged between upper and lower rotary units, the circulation unit and the rotary units being vertically displaceable along a guide track, characterized by at least the upper rotary unit being displaceable independently of the circulation unit;

the circulation unit including a housing provided with a centre bore a ranged to accommodate a portion of a pipe;

the centre bore being defined by upper and lower annular sealing elements that are rotatably supported in the housing; and the sealing elements being provided with a centre opening which, by the expansion of said sealing elements, is closable or fits tightly against the pipe by the abutment of inner surface against the pipe.

Any rotation of a drill string and any rotation of a pipe during connection to or disconnection from the drill string may be provided by rotatable tongs which are arranged outside the housing of the circulation unit.

The lower rotary unit and the circulation unit may be provided with a common linear drive which is arranged to move said rotary unit and the circulation unit in a synchronous vertical movement along the guide track of the derrick.

The housing may be provided with a gate valve which, in a closed state, forms a fluid-tight partition between an upper chamber and a lower chamber.

The gate valve may be a ball valve with a rotational axis that is perpendicular to the centre axis of the housing and a centre opening which, in the open state of the gate valve, forms a portion of the centre bore of the circulation unit.

The circulation unit may be provided with an upper chamber and a lower chamber which are each connected to a drilling-fluid system via individually closable drilling-fluid lines connected to a valve system.

The saver sub may be rotatably connected to a closable drilling-fluid line which is connected to a drilling-fluid system via a valve system.

An end face on each of the sealing elements may be connected in a fluid-tight manner to a rotatable packer pipe that projects into respectively an upper chamber and a lower chamber in the housing and is surrounded by a packer assembly that fits tightly against the circumference of the packer pipe and against the housing.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
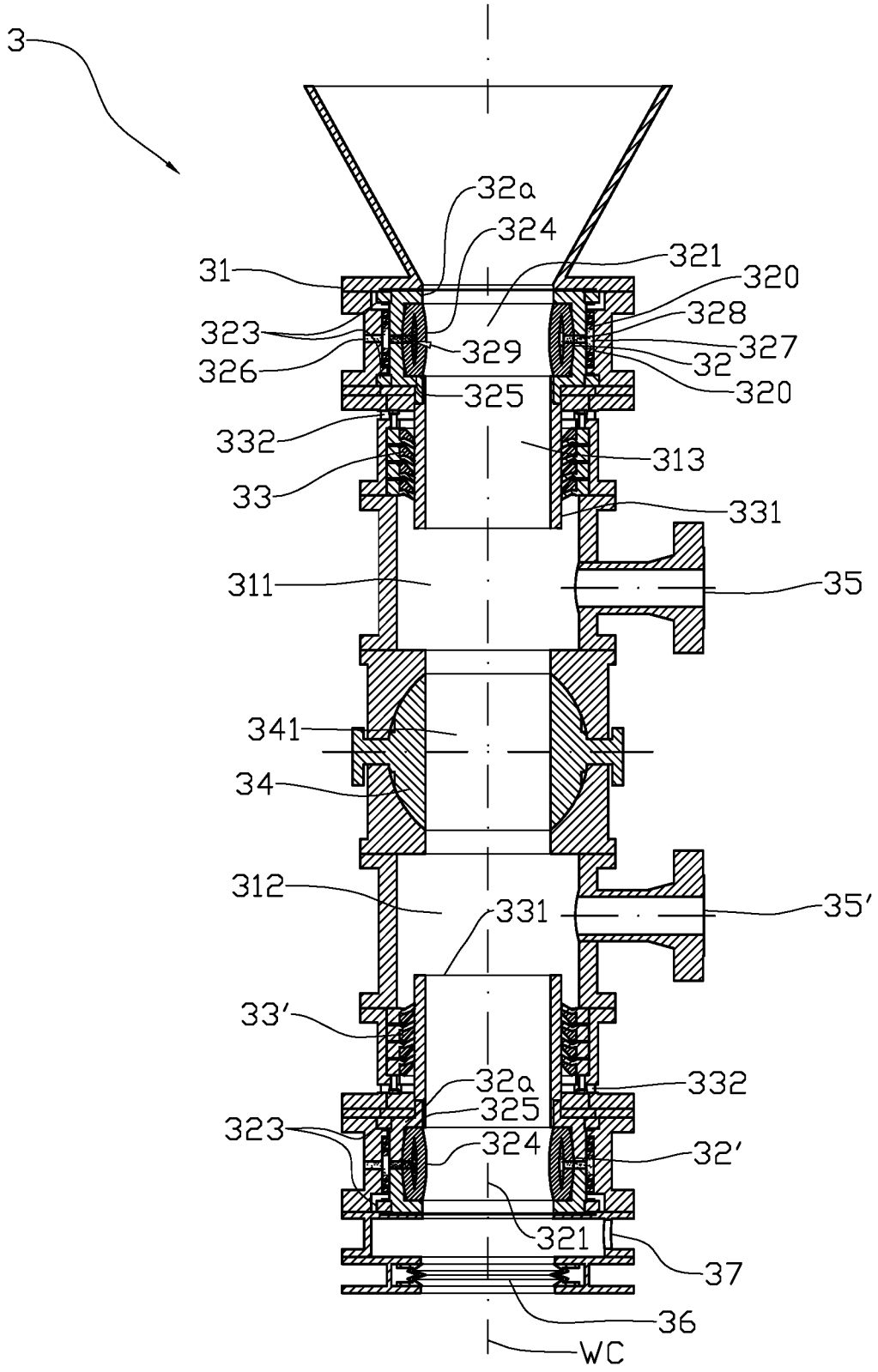
FIG. 1 shows an axial section through the circulation unit in accordance with the invention.

On a derrick 1, upper and lower rotary units 2, 2' and a circulation unit 3 are arranged, vertically displaceable along guide tracks 11, 11' on the derrick 1. The guide tracks 11, 11' may coincide or be separate. The vertical displacement is provided by means of linear drives 25, 25' which, through their engagements with the guide tracks 11, 11', typically by toothed wheels meshing with toothed portions (not shown) of the guide tracks 11, 11', can forcingly drive the respective rotary units 2, 2' and the circulation unit 3 independently of the forces acting on the units 2, 2', 3 via connected elements, for example a well pressure.

Figure 2:
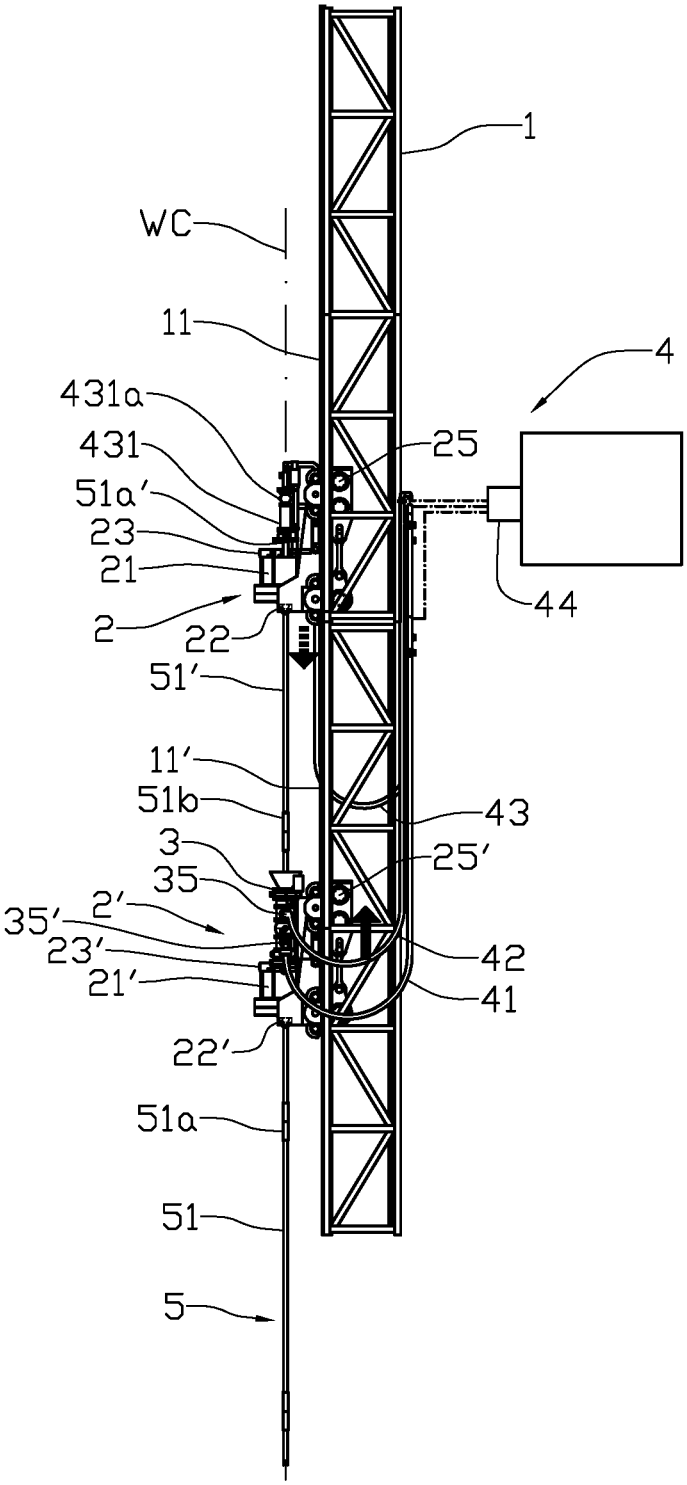
FIG. 2 shows, on a smaller scale, a side view of an arrangement in accordance with the invention, in which a drill string is rotated by an upper rotary unit, and drilling fluid is supplied via a saver sub connected to the drill string, while a circulation unit and a lower rotary unit are being displaced vertically towards the upper rotary unit.

Reference is first made to FIG. 2 in particular. A drilling-fluid system 4 includes a valve system 44, first and second drilling-fluid lines 41, 42 connected to respectively upper and lower fluid ports 35, 35' arranged on the circulation unit 3, and a third drilling-fluid line 43 connected to a saver sub 431 via a rotary coupling (swivel) 431*a*, so that the saver sub 431 may rotate around its own centre axis independently of the connected drilling-fluid line 43. The drilling-fluid lines 41, 42, 43 are connected to the valve system 44 so that a drilling-fluid flow in one of the drilling-fluid lines 41, 42, 43 may be controlled independently of the drilling-fluid flow in each of the other drilling-fluid lines 41, 42, 43.

A drill string 5 which has been made up, in a manner known per se, from several pipes or pipe sections 51, 51' extends down a borehole (not shown) with its centre axis coinciding with a drilling-centre axis WC.

The saver sub 431 is connectable to an upper end 51*a*, 51*a'* of a pipe.

Reference is now made to FIG. 1. The circulation unit 3 includes a housing 31 which is divided by means of a gate valve 34 into upper and lower chambers 311, 312. The gate valve 34 which, for practical purposes, may be a ball valve with a rotational axis perpendicular to the centre axis of the housing 31 exhibits, in its open position, a centre opening 341 which coincides with a centre bore 313 extending through the entire housing 31. At the end portions of the housing 31, respectively upper and lower sealing elements 32, 32' are arranged, with a closable centre opening 321 of a kind which, when a pressure fluid is supplied from a pressure-supply unit (not shown) to an internal packer cavity 329, may expand radially until an inner sealing surface 324 sealingly us abuts against a surrounded portion of the drill string 5, the pipe 51, 51' or the saver sub 431, or, when the sealing element 32, 32' is not surrounding the drill string 5, the pipe 51, 51' or the saver sub 431, until closing the centre opening 321 completely. The pressure fluid is supplied to the sealing elements 32, 32' from a pressure-fluid system (not shown) through a pressure-fluid port 326 and an annular space 327 surrounding the sealing elements 32, 32'. There are several fluid passages 328 extending between the packer cavity 329 and the annular space 327. In the axial direction, the annular space 327 is defined in a fluid-sealing manner by several pressure-fluid seals 320.

The sealing elements 32, 32' are supported in the housing 31 rotatable around the centre axis of the centre bore 313, bearings 323 arranged between bearing rings 32*a*, within which, respectively, the sealing elements 32, 32' are arranged, and the housing 31 being arranged to take strains in the radial and axial directions. End faces 325 of each sealing element 32, 32' have a fluid-tight fit against the bearing ring 32*a*. From the bearing ring 32*a*, a packer pipe 331 which fits tightly, at an end portion, against the bearing ring 32*a* and rotates with the bearing ring 32*a* and the sealing element 32 and 32', respectively, projects into the respective chamber 311, 312. The packer pipe 331 is surrounded by, respectively, upper and lower packer assemblies 33, 33' of a type that allows the packer pipe 331 to rotate without the sealing function deteriorating to any extent worth mentioning, for example so-called wash-pipe seals. Drilling fluid is thereby prevented from penetrating through the bearing 323 of the sealing elements 32, 32' into the annular space 327 and mixing with the pressure fluid which is being supplied to the sealing elements 32, 32'. To further prevent such a mixing of drilling fluid and pressure fluid, the housing 31 is provided with packer drains 332 that will drain any leakage of drilling fluid from the housing 31.

The internal pressure of the sealing elements 32, 32' may be adjusted to the drilling-fluid pressure which reflects the prevailing well pressure.

In a lower end portion, the housing 31 is also provided with a bottom packer 36 which, by expansion, is arranged to close the centre bore 313. Above the bottom packer 36, the housing is provided with a drain opening 37.

The rotary units 2, 2' include a rotatable tong 21, 21' with a rotary drive 23, 23', and a hanging-off device 22, 22', typically in the form of a slips arrangement.

Figure 3:
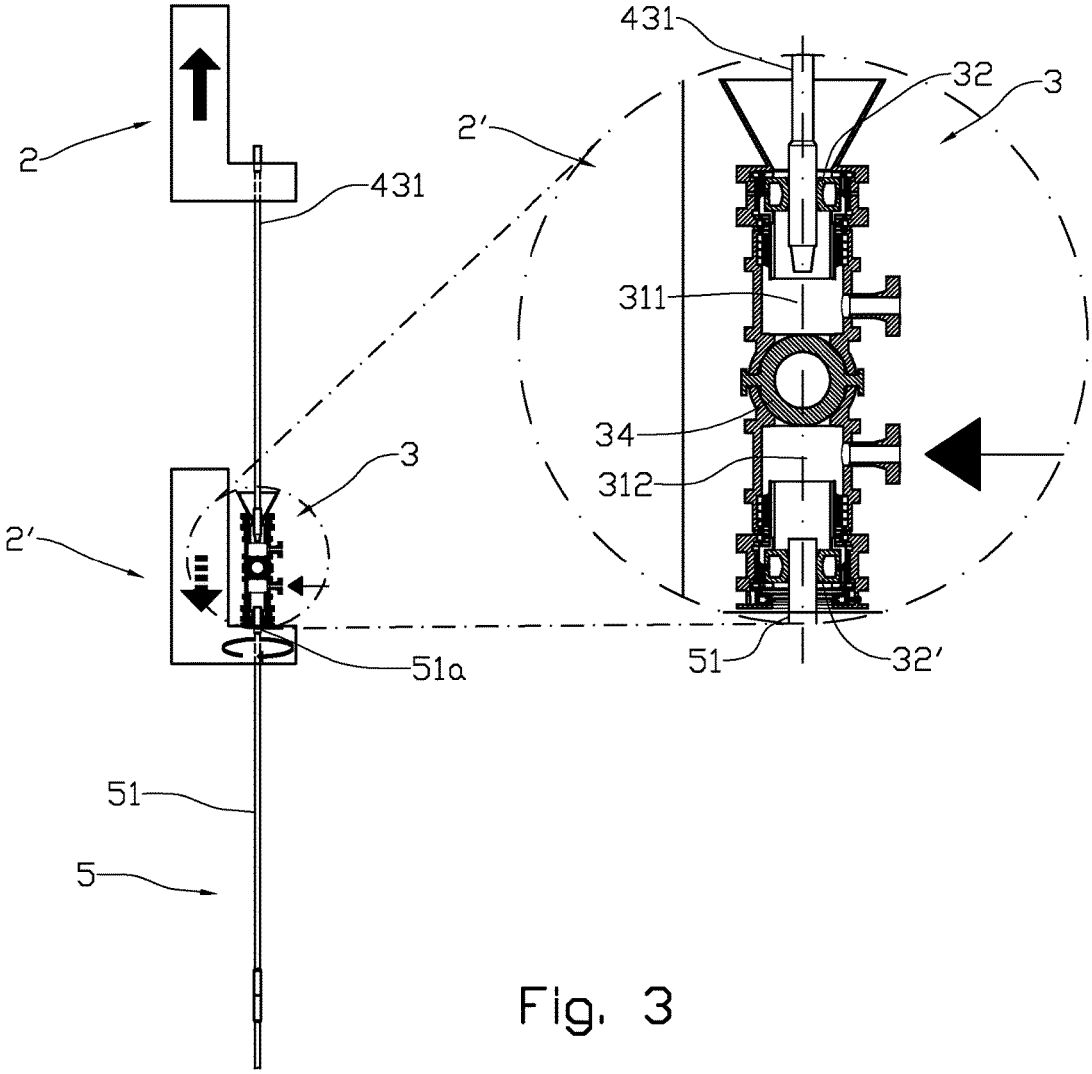
FIG. 3 shows a principle drawing of the arrangement in accordance with the invention by an axial section through the circulation unit, in which the upper end of the drill string is positioned in a lower chamber of the circulation unit and the saver sub is disconnected from the drill string and has its lower end positioned in the upper chamber, the drill string being rotated by the lower rotary unit and drilling fluid being supplied through the lower chamber of the circulation unit.
Figure 4:
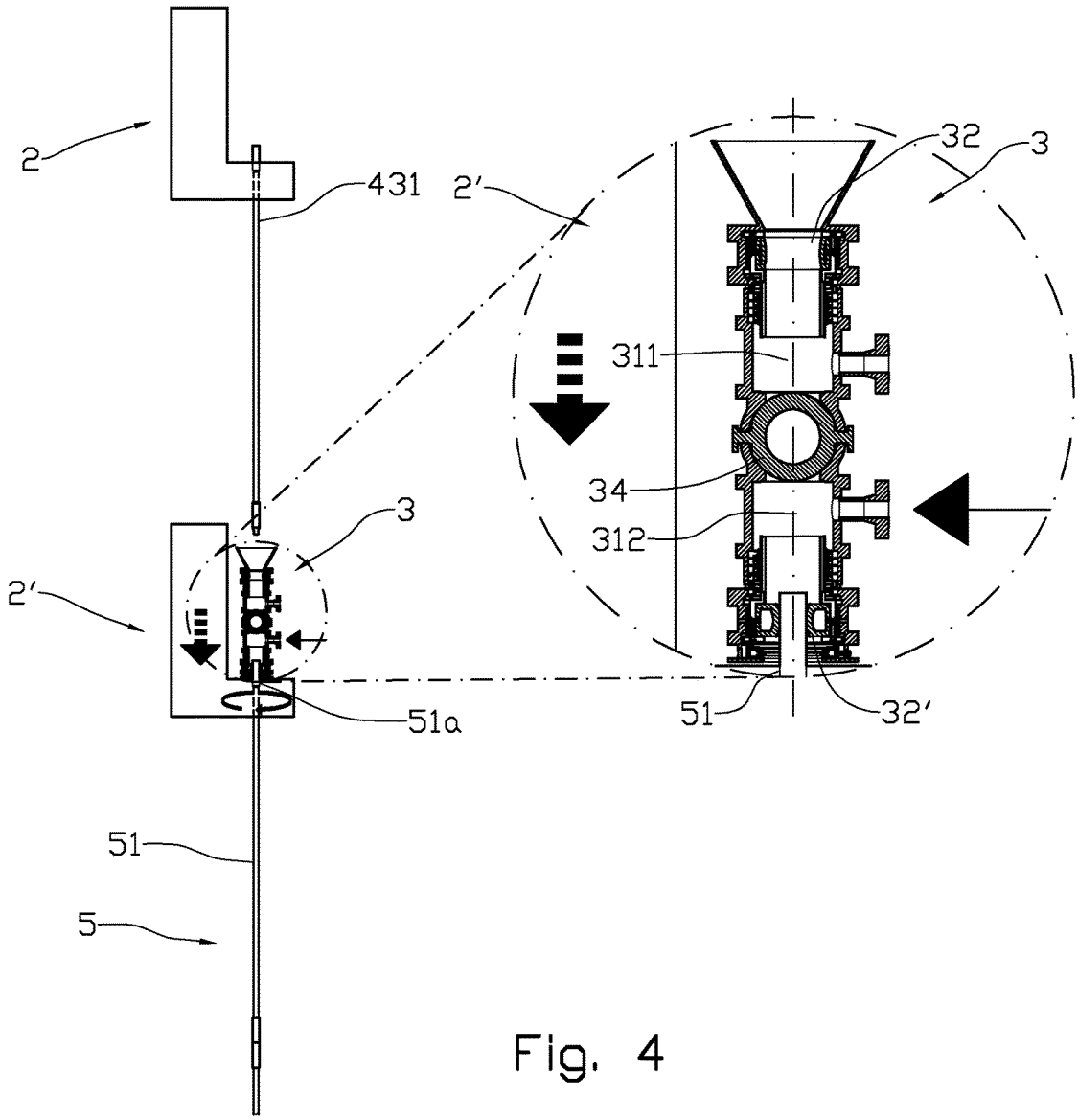
FIG. 4 shows the drill string in rotation continued by the lower rotary unit and the saver sub having been pulled out of the circulation unit.

In one embodiment, the circulation unit 3 is connected to the lower rotary unit 2', as it is shown in FIGS. 2-4. It is also conceivable for the circulation unit 3 to be independent of said lower rotary unit 2'.

When a continuous drilling operation is performed with the arrangement in accordance with the invention, it may be performed in the following manner:

In a first phase of a drilling sequence, an upper end of the drill string 5 projects through the circulation unit 3. The third drilling-fluid line 43 is connected, via the saver sub 431, to an upper end 51*a* of the drill string 5. Drilling fluid is supplied to a centre bore of the drill string 5 via the saver sub 431. The drill string 5 is kept in rotation by the upper rotary unit 2. The upper and lower sealing elements 32, 32' are open, and the drill string 5 is moved freely relative to the circulation unit 3. The upper rotary unit 2 and the drill string 5 are moved downwards according to the achieved rate of penetration.

In a second phase of the drilling sequence, the circulation unit 3 and the lower rotary unit 2' are moved upwards towards the upper rotary unit 2. The upper end 51*a* of the drill string 5 and a lower portion 431*a* of the saver sub 431 are moved into the circulation unit 3 so that the upper end 51*a* of the drill string 5 is in the lower chamber 312. The drill string 5 is gripped by the lower rotary unit 2' which takes over the drill-string rotation. The saver sub 431 remains hung off in the upper rotary unit 2. The sealing elements 32, 32' are closed around the rotating drill string 5 and the saver sub 431, respectively. Drilling fluid is supplied to the lower chamber 312 through the lower fluid port 35'. The saver sub 431 is disconnected from the drill string 5 by the upper rotary unit 2 holding the saver sub 431 back while the lower rotary unit 2' rotates the drill string 5. The saver sub 431 is pulled out of the lower chamber 312, the gate valve 34 is closed, and the supply of drilling fluid through the saver sub 431 is stopped. The upper sealing element 32 is opened, and the saver sub 431 is pulled out of the circulation unit 3. Drilling-fluid residues may be drained through the upper fluid port 35. The drilling operation is maintained by the rotation and displacement of the lower rotary unit 2' and the circulation unit 3, and the supply of drilling fluid is maintained through the lower chamber 312 which is kept closed to the surroundings by means of the closed gate valve 34 and the lower sealing element 32' which fits tightly around a portion of the drill string 5.

In a third phase of the drilling sequence, a next pipe 51' which is to be joined to the drill string 5 is moved in by means of a manipulator (not shown) or the like to the drilling-centre axis WC and held fixed there. The upper rotary unit 2 rotates the saver sub 431 to connect it to the upper end 51*a* of the pipe 51'. The pipe 51' is moved with its lower end 51*b* into the circulation unit 3 while the upper sealing element 32 is open. The upper sealing element 32 is closed around the pipe 51'. Drilling fluid is supplied to the upper chamber 311 through the saver sub 431, the gate valve 34 is opened, and the supply of drilling fluid through the lower fluid port 35' is stopped as the drill string 5 is now being supplied with drilling fluid from the upper chamber 311 and through the open gate valve 34. The upper rotary unit 2 moves, during rotation, the pipe 51' to connect it to the drill string 5, the pipe 51' being rotated faster than the drill string 5. Drilling fluid is supplied to the drill string 5 through the saver sub 431. The sealing elements 32, 32' are opened, possibly after the chambers 311, 312 of the circulation unit 3 have been drained through the upper fluid port 35 and drain opening 37, respectively.

The drilling operation continues by repetition from phase 1 when new pipes 51' are successively connected as the drill string 5 works its way into the underground.

By means of the arrangement in accordance with the invention, a simple system for the continuous supply of drilling fluid during drilling has been provided, and the drilling may be carried out in continuous progress. The central units used are uncomplicated as only one main function has been assigned to each of the units, namely:

a) The first rotary unit 2 provides for the hanging-off, rotation and vertical displacement of the drill string 5 or pipe 51, 51' connected to the saver sub 431.

b) The second rotary unit 2' provides for the hanging-off, rotation and vertical placement of the drill string 5.

c) The circulation unit 3 provides for fluid-tight, movable connection between a drilling-fluid system 4 and the rotating drill string 5 in cooperation with the saver sub 431 for drilling-fluid supply to alternate between a supply directly to the drill string 5 and a supply via the next pipe 51, 51' in the connecting phase.

The circulation unit 3 according to the invention provides an environmentally friendly handling of the drilling fluid, as residual amounts of the drilling fluid may be drained from the circulation unit before the sealing elements 32, 32' are released from the drill string 5 and so on. The packer assemblies 33, 33' of the circulation unit 3 also ensure a better durability of the rotary bearings 323 and so on in that the pressure fluid, which usually also functions as a lubricant for said bearings, will not be contaminated so easily with drilling fluid as the drilling fluid is prevented from entering the pressure-fluid supply channel 327, 328.

By using a circulation unit 3, which has the sole task of maintaining the supply of drilling fluid to the drill string 5, and letting the rotation, hanging-off and vertical displacement of the drill string and pipe be carried out by the rotary units 2, 2', adjustments of the arrangement to other pipe dimensions could be done more rationally, as no intervention is needed in the closed circulation unit 3 when gripping elements and so on in the rotatable tongs 21, 21' and the hanging-off devices 22, 22' are to be replaced.

By separating the circulation unit 3 from the lower rotary unit 2', the circulation unit 3 being provided with a separate linear drive (not shown) for the vertical displacement of the circulation unit 3 independently of the lower rotary unit 2', additional advantages can be achieved in consequence of greater operational freedom during continuous drilling with continuous drilling-fluid circulation.

The invention claimed is:

1. A circulation unit for an arrangement arranged to continuously circulate drilling fluid during drilling, the circulation unit comprising:

a housing with a center bore arranged to accommodate a portion of a pipe;

wherein the center bore is defined by upper and lower annular sealing elements which are rotatably supported in the housing for rotation relative thereto;

wherein each of the sealing elements is provided with a center opening which, by radial expansion of each of the sealing elements into the center opening, is closable, or each of the sealing elements fits tightly against the pipe by abutment of an inner sealing surface against the pipe; and a valve in a closed state forms a fluid-tight partition between upper and lower chambers in the housing, wherein each of the sealing elements is connected in a fluid-tight manner to a rotatable packer pipe projecting into the respective chamber and surrounded by a packer assembly that fits tightly against a circumference of the packer pipe and against the housing, and wherein each of the sealing elements is formed internally therein with an expandable cavity configured to be enlarged to enable closing of the center opening or the abutment of the inner sealing surface against the pipe.

2. The circulation unit in accordance with claim 1, wherein the expandable cavity is in fluid communication with a pressure-fluid port via several fluid passages and an annular space surrounding each of the sealing elements.

3. The circulation unit in accordance with claim 1, wherein, between the packer assembly and a pressure-fluid seal defining an annular space surrounding each of the sealing elements, a packer drain has been arranged.

4. The circulation unit in accordance with claim 1, wherein the packer pipe is connected to each of the sealing elements via a bearing ring which fits fluid-tightly against end faces of each of the sealing elements.

5. The circulation unit in accordance with claim 4, wherein a pressure fluid supplied to each of the sealing elements serves as a lubricant to the bearing ring.

6. The circulation unit in accordance with claim 1, wherein each of the sealing elements is configured to be supplied with a pressure fluid to enable the radial expansion of each of the sealing elements.

7. The circulation unit in accordance with claim 6, wherein the pressure fluid is supplied internally within each of the sealing elements.

8. The circulation unit in accordance with claim 1, wherein each of the sealing elements is provided with an internal fluid pressure which is adjustable.

9. The circulation unit in accordance with claim 1, wherein each packer assembly surrounding each of the packer pipes is configured to prevent the drilling fluid from contaminating a pressure fluid supplied to each of the sealing elements.

10. An arrangement for the continuous circulation of drilling fluid during continuous drilling, in which a circulation unit is arranged between upper and lower rotary units, the circulation unit and the rotary units being vertically displaceable along a guide track of a derrick, wherein at least the upper rotary unit is displaceable independently of the circulation unit;

the circulation unit includes a housing provided with a center bore arranged to accommodate a portion of a pipe;

the center bore is defined by upper and lower annular sealing elements which are rotatably supported in the housing for rotation relative thereto; and each of the sealing elements is provided with a center opening which, by radial expansion of each of the sealing elements into the center opening, is closable, or each of the sealing elements fits tightly against the pipe by the abutment of an inner sealing surface against the pipe, wherein each of the sealing elements is formed internally therein with an expandable cavity configured to be enlarged to enable closing of the center opening or the abutment of the inner sealing surface against the pipe.

11. The arrangement in accordance with claim 10, wherein any rotation of a drill string and any rotation of a pipe during connection to or disconnection from the drill string are provided by rotatable tongs which are arranged outside the housing of the circulation unit.

12. The arrangement in accordance with claim 10, wherein the lower rotary unit and the circulation unit are provided with a common linear drive which is arranged to displace the lower rotary unit and the circulation unit in a synchronous vertical movement along the guide track of the derrick.

13. The arrangement in accordance with claim 10, wherein the housing is provided with a valve which, in a closed state, forms a fluid-tight partition between upper and lower chambers of the circulation unit.

14. The arrangement in accordance with claim 13, wherein the valve is a ball valve with a rotational axis which is perpendicular to the center axis of the housing and a center opening which, in an open state of the valve, forms a portion of the center bore of the circulation unit.

15. The arrangement in accordance with claim 10, wherein the circulation unit is provided with upper and lower chambers which are each connected to a drilling-fluid system via individually closable drilling-fluid lines connected to a valve system.

16. The arrangement in accordance with claim 10, wherein a saver sub is rotatably connected to a closable drilling-fluid line which is connected to a drilling-fluid system via a valve system.

17. The arrangement in accordance with claim 10, wherein an end face of each of the sealing elements is connected in a fluid-tight manner to a rotatable packer pipe which projects into respective upper and lower chambers in the housing and is surrounded by a packer assembly fitting tightly against the circumference of the packer pipe and against the housing.

18. A circulation unit for an arrangement arranged to continuously circulate drilling fluid during drilling, the circulation unit comprising:

a housing with a center bore arranged to accommodate a portion of a pipe;

wherein the center bore is defined by upper and lower annular sealing elements which are rotatably supported in the housing;

wherein each of the sealing elements is provided with a center opening which, by the expansion of each of the sealing elements, is closable, or each of the sealing elements fits tightly against the pipe by the abutment of an inner sealing surface against the pipe; and a valve in a closed state forms a fluid-tight partition between upper and lower chambers in the housing, wherein each of the sealing elements is connected in a fluid-tight manner to a rotatable packer pipe projecting into the respective chamber and surrounded by a packer assembly that fits tightly against the circumference of the packer pipe and against the housing, and wherein each of the sealing elements is provided with an expandable cavity which is in fluid communication with a pressure-fluid port via several fluid passages and an annular space surrounding each of the sealing elements.

19. A circulation unit for an arrangement arranged to continuously circulate drilling fluid during drilling, the circulation unit comprising:

a housing with a center bore arranged to accommodate a portion of a pipe;

wherein the center bore is defined by upper and lower annular sealing elements which are rotatably supported in the housing for rotation relative thereto;

wherein each of the sealing elements is provided with a center opening which, by radial expansion of each of the sealing elements into the center opening, is closable, or each of the sealing elements fits tightly against the pipe by abutment of an inner sealing surface against the pipe;

a valve in a closed state forms a fluid-tight partition between upper and lower chambers in the housing;

wherein each of the sealing elements is connected in a fluid-tight manner to a rotatable packer pipe projecting into the respective chamber and surrounded by a packer assembly that fits tightly against a circumference of the packer pipe and against the housing, and wherein each of the sealing elements is provided with an expandable cavity which is in fluid communication with a pressure-fluid port via several fluid passages and an annular space surrounding each of the sealing elements.

20. A circulation unit for an arrangement arranged to continuously circulate drilling fluid during drilling, the circulation unit comprising:

a housing with a center bore arranged to accommodate a portion of a pipe;

wherein the center bore is defined by upper and lower annular sealing elements which are rotatably supported in the housing for rotation relative thereto;

wherein each of the sealing elements is provided with a center opening which, by radial expansion of each of the sealing elements into the center opening, is closable, or each of the sealing elements fits tightly against the pipe by abutment of an inner sealing surface against the pipe;

a valve in a closed state forms a fluid-tight partition between upper and lower chambers in the housing;

wherein each of the sealing elements is connected in a fluid-tight manner to a rotatable packer pipe projecting into the respective chamber and surrounded by a packer assembly that fits tightly against a circumference of the packer pipe and against the housing, and wherein each of the sealing elements is configured to be supplied with a pressure fluid to enable the radial expansion of each of the sealing elements.

21. The circulation unit in accordance with claim 20, wherein the pressure fluid is supplied internally within each of the sealing elements.

22. A circulation unit for an arrangement arranged to continuously circulate drilling fluid during drilling, the circulation unit comprising:

a housing with a center bore arranged to accommodate a portion of a pipe;

wherein the center bore is defined by upper and lower annular sealing elements which are rotatably supported in the housing for rotation relative thereto;

wherein each of the sealing elements is provided with a center opening which, by radial expansion of each of the sealing elements into the center opening, is closable, or each of the sealing elements fits tightly against the pipe by abutment of an inner sealing surface against the pipe;

a valve in a closed state forms a fluid-tight partition between upper and lower chambers in the housing;

wherein each of the sealing elements is connected in a fluid-tight manner to a rotatable packer pipe projecting into the respective chamber and surrounded by a packer assembly that fits tightly against a circumference of the packer pipe and against the housing, and wherein each of the sealing elements is provided with an internal fluid pressure which is adjustable.

23. A circulation unit for an arrangement arranged to continuously circulate drilling fluid during drilling, the circulation unit comprising:

a housing with a center bore arranged to accommodate a portion of a pipe;

wherein the center bore is defined by upper and lower annular sealing elements which are rotatably supported in the housing for rotation relative thereto;

wherein each of the sealing elements is provided with a center opening which, by radial expansion of each of the sealing elements into the center opening, is closable, or each of the sealing elements fits tightly against the pipe by abutment of an inner sealing surface against the pipe;

a valve in a closed state forms a fluid-tight partition between upper and lower chambers in the housing;

wherein each of the sealing elements is connected in a fluid-tight manner to a rotatable packer pipe projecting into the respective chamber and surrounded by a packer assembly that fits tightly against a circumference of the packer pipe and against the housing;

wherein the packer pipe is connected to each of the sealing elements via a bearing ring which fits fluid tightly against end faces of each of the sealing elements, and wherein a pressure fluid supplied to each of the sealing elements serves as a lubricant to the bearing ring.

* * * * *